US009033185B2

(12) United States Patent
Nimmo et al.

(10) Patent No.: US 9,033,185 B2
(45) Date of Patent: May 19, 2015

(54) VARIABLE VOLUME POCKET, FLUID DISPENSING DEVICE COMPRISING SAID POCKET AND METHOD FOR FILLING SAID DEVICE

(75) Inventors: Chris Nimmo, Amersham (GB); Olivier Bertaud, Boulogne (FR)

(73) Assignee: Power Container Corp, Somerset, NJ (US)

( * ) Notice: Subject to any disclaimer, the term of this patent is extended or adjusted under 35 U.S.C. 154(b) by 1189 days.

(21) Appl. No.: 12/519,103

(22) PCT Filed: Dec. 11, 2007

(86) PCT No.: PCT/FR2007/052475

§ 371 (c)(1), (2), (4) Date: Mar. 18, 2010

(87) PCT Pub. No.: WO2008/078037

PCT Pub. Date: Jul. 3, 2008

(65) Prior Publication Data

US 2012/0097706 A1 Apr. 26, 2012

Related U.S. Application Data

(63) Continuation-in-part of application No. PCT/IB2007/000342, filed on Feb. 14, 2007, which is a continuation-in-part of application No. 11/610,842, filed on Dec. 14, 2006, now Pat. No. 8,505,774.

(60) Provisional application No. 60/955,748, filed on Aug. 14, 2007, provisional application No. 60/714,528, filed on Dec. 16, 2005.

(30) Foreign Application Priority Data

Aug. 14, 2007 (FR) ..... 07 05855

(51) Int. Cl.
*B65D 35/28* (2006.01)
*B65D 83/62* (2006.01)
*B65D 83/48* (2006.01)

(52) U.S. Cl.
CPC ..... *B65D 83/62* (2013.01); *B65D 83/48* (2013.01)

(58) Field of Classification Search
CPC ..... B65D 83/0061; B65D 83/48; B65D 83/62
USPC ..... 222/94, 95, 105, 386.5, 394, 402.1, 1
See application file for complete search history.

(56) References Cited

U.S. PATENT DOCUMENTS 3,731,854 A 5/1973 Casey
4,387,833 A 6/1983 Venus, Jr.

(Continued)

FOREIGN PATENT DOCUMENTS

CH 678514 9/1991
DE 2304538 1/1973

(Continued)

*Primary Examiner* — J. Casimer Jacyna
(74) *Attorney, Agent, or Firm* — McDonnell Boehnen Hulbert & Berghoff LLP

(57) ABSTRACT

The invention relates to a bag of variable volume able to contain fluids and designed to be introduced into a container through the container's neck, said bag consisting of a pouch with one closed end and one open end, the open end being dimensionally stable over temperature ranges of from −30 to 55° C., to a device incorporating said bag and to a process for filling it.

14 Claims, 4 Drawing Sheets

(56) References Cited

U.S. PATENT DOCUMENTS

Figure 1C:
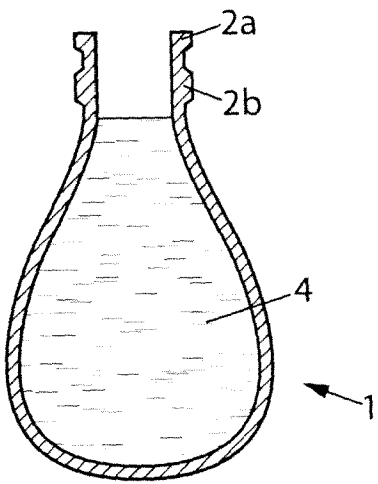

| | | | | |
|---|---|---|---|---|
| 4,423,829 | A | 1/1984 | Katz | |
| 4,865,224 | A | 9/1989 | Streck | |
| 4,964,540 | A | 10/1990 | Katz | |
| 4,969,577 | A | 11/1990 | Werding | |
| 5,044,524 | A * | 9/1991 | Pistek | 222/212 |
| 5,111,971 | A | 5/1992 | Winer | |
| 5,219,005 | A | 6/1993 | Stoffel | |
| 5,263,519 | A * | 11/1993 | Reyner | 141/20 |
| 5,265,765 | A | 11/1993 | Maier | |
| 5,388,716 | A | 2/1995 | Stoffel et al. | |
| 5,505,039 | A | 4/1996 | Maier | |
| 5,622,282 | A | 4/1997 | Yazawa et al. | |
| 5,798,169 | A * | 8/1998 | Smith | 428/212 |
| 5,927,551 | A | 7/1999 | Taylor et al. | |
| 6,196,275 | B1 | 3/2001 | Yazawa et al. | |
| 6,345,739 | B1 | 2/2002 | Mekata | |
| 6,439,430 | B1 | 8/2002 | Gilroy, Sr. et al. | |
| 6,562,279 | B2 * | 5/2003 | Slat | 264/513 |
| 6,789,702 | B2 | 9/2004 | O'Connor et al. | |
| 7,364,361 | B2 * | 4/2008 | Turvey et al. | 383/33 |
| 7,819,382 | B2 * | 10/2010 | Schuetz et al. | 251/144 |
| 2004/0226964 | A1 | 11/2004 | Bourque et al. | |
| 2005/0236427 | A1 * | 10/2005 | Farha et al. | 222/105 |
| 2008/0272145 | A1 | 11/2008 | Nimmo et al. | |
| 2010/0140290 | A1 * | 6/2010 | Py | 222/1 |

FOREIGN PATENT DOCUMENTS

| | | |
|---|---|---|
| DE | 7244369 U | 10/1973 |
| DE | 2304538 | 8/1974 |
| EP | 0105537 | 8/1983 |
| EP | 0486630 | 5/1992 |
| EP | 0718213 | 6/1996 |
| EP | 718213 | 6/1996 |
| EP | 0972723 | 1/2000 |
| FR | 2882037 | 8/2006 |
| FR | 2893315 | 5/2007 |
| WO | 98/43882 | 10/1998 |
| WO | 01/89956 | 11/2001 |
| WO | 2006/087462 | 8/2006 |

* cited by examiner

VARIABLE VOLUME POCKET, FLUID DISPENSING DEVICE COMPRISING SAID POCKET AND METHOD FOR FILLING SAID DEVICE

This application is a US national phase of International Application No. PCT/FR2007/052475, filed Dec. 11, 2007, which claims the benefit of U.S. provisional application No. 60/955,748, filed on Aug. 14, 2007, and of FR 07 05855, filed Aug. 14, 2007, and is a continuation-in-part of international application no. PCT/IB2007/000342, filed Feb. 14, 2007, which is a continuation-in-part of U.S. application Ser. No. 11/610,842, filed Dec. 14, 2006, now U.S. Pat. No. 8,550,774, which claims the benefit of U.S. provisional application No. 60/714,528, filed Dec. 16, 2005.

The invention relates to a bag of variable volume designed to be introduced through the neck of an outer container under pressure before it is filled with a fluid. The invention also relates to said device able to dispense fluids which comprises the bag of the invention, and to a process for filling said device.

In many areas of industry, and especially detergents, medicines and cosmetic products, fluids, and principally liquids containing clearing agents, disinfectants and medicinal or cosmetic substances, must be dispensed usually in the form of a spray, optionally under pressure for the purposes of their use.

An example of this is isotonic seawater, which has applications such as irrigation of the nasal fossae.

Devices of the type in question are already known, their features being described in U.S. Pat. Nos. 4,387,833, 4,423,829, 5,927,551 and 4,964,540.

In the case of these devices, which can be used in all positions, even upside down, the fluid is dispensed not by the action of a propellant gas but by the action of mechanical stress applied to a container in the form of a bag or pouch of variable volume, the general form of which is that of a cylinder with longitudinal folds, filled with the fluid which is to be dispensed.

With the devices described in the aforesaid American patents, the mechanical stress, which causes the fluid to be dispensed under pressure from the variable-volume container, is exerted by a cylindrical sleeve made of an elastic material, typically a rubber with special elastic properties, which encloses the bag- or pouch-like container and which has a diameter slightly greater than that of the variable-volume container when the latter is emptied.

The sleeve in question is then fitted and the fluid to be dispensed is introduced under pressure into the container, which expands against the opposing action of the elastic sleeve, the compressive force of which on the container increases with the expansion of the latter as the fluid to be dispensed is introduced into it.

The bag- or pouch-like container has a control for operating a valve to dispense the fluid, the assembly being arranged inside a conventional container or can of the type used in the aerosol sector, especially for cosmetics.

These devices, which are very robust, have always given complete satisfaction to users, but their cost price due to the cost of the rubber of which the elastic sleeve used inside them is made is a drawback.

There are other devices of the type in question in which a container of variable volume, designed to be filled with the fluid to be dispensed and also equipped with a control suitable for operating a valve to dispense the pressurized fluid, is arranged inside an outer container capable of withstanding high pressures, such as pressures greater than 20 bar; this outer container is filled with an inert pressurized gas, the empty variable-volume container being in position and then being filled with the fluid to be dispensed by introducing the latter at sufficient pressure to overcome the pressure exerted on the container by the inert gas filling the outer container; which has the effect of further increasing the pressure of the inert gas.

In the case of these devices, the stress applied to the inner variable-volume container, and by which the pressurized fluid can be dispensed, is therefore pneumatic in nature.

These devices have not had as much success as those described above, partly because of their fragility if they are knocked or dropped, especially at the join between the variable-volume container and the control whose operation allows the pressurized fluid to be dispensed.

Other devices of the type in question have also been described, as for example in DE-OS 2304538, U.S. Pat. No. 4,969,577, U.S. Pat. No. 5,219,006, U.S. Pat. No. 5,505,289, U.S. Pat. No. 5,388,716, U.S. Pat. No. 6,345,739, EP718213 and CH678614.

These devices have certain drawbacks, particularly relating to their manner of filling or to their fragility, or cannot even be produced by industrial means.

In patent FR2882037, the Applicant described a device that does not have the disadvantages of the prior art devices and in particular is much less fragile than them. However, when subjected to extreme temperatures, said device may become more susceptible to leaks.

It is the inventors' merit to have found, surprisingly and unexpectedly, that this risk of leaks under extreme conditions can be averted by using a bag of variable volume whose open end is dimensionally stable over temperature ranges of from −30 to 55° C., preferably from −5 to 50° C. and more preferably from 10 to 40° C.

The invention therefore relates to a bag of variable volume able to contain fluids and designed to be introduced, empty, into a container through the container's neck, said bag consisting of a pouch with one closed end and one open end, the open end being dimensionally stable over temperature ranges of from −30 to 55° C., preferably from −5 to 50° C. and more preferably from 10 to 40° C.

In accordance with the present invention, said open end is said to be "dimensionally stable" insofar as, within a temperature range of from −30 to 55° C., preferably from −5 to 50° C. and more preferably from 10 to 40° C., the coefficient of expansion of said end is divided by 1.5, preferably by 2, and still more preferably by 3, by comparison with the rest of the bag.

The coefficient of expansion is the ratio M/m, M being the maximum value reached by the largest dimension of said open end within the temperature range of from −30 to 55° C., preferably from −5 to 50° C. and more preferably from 10 to 40° C., and m being the minimum value reached by the largest dimension of said open end in the temperature range of from −30 to 55° C., preferably from −5 to 50° C. and more preferably from 10 to 40° C.

This dimensional stability maintains the leaktightness of devices incorporating said variable-volume bag, whatever their range of temperatures of use and/or storage throughout the life of said device.

Pressurized devices incorporating said bag thus meet the requirements of Regulation No. 842/2006 of the European Parliament and Council and the requirements of the US Department of Transportation and Packaging (see CFR 49, Volume 2:49 CFR 173.306).

Since said bag is designed to be adapted to any type of outer container, it can be provided with various means for attaching it to the outer container. Thus, in one particular embodiment, its free end has a screwthread, so that it will be attached to the outer container by screwing it into the neck of said outer container. In this embodiment, at least part and preferably all of the screwthreaded free end is dimensionally stable.

In another embodiment, said open end is designed to be crimped onto the outer container, directly or via a cup as described in Applicant's patent applications FR0501511, FR0511614 and PCT/FR2006/000338, the teaching of which is incorporated by reference. In this embodiment, the outer wall of the open end has at least one radial protuberance designed for crimping.

In another embodiment, the free edge of the open end has at least one radial ring designed for welding to the outer container.

Given the fact that the bag is of variable volume, the material of which it is made must permit this variability of volume.

The variable-volume bag is thus advantageously made of polyethylene terephthalate or polyethylene naphthalate or of any other suitable synthetic material offering similar properties.

In particular, the variable-volume bag may be made from laminates in which at least one of the component layers gives the laminate sufficient mechanical strength, another layer may give gas-barrier properties, notably to oxygen, nitrogen and/or carbon dioxide, and/or still another layer may give properties of chemical resistance to the fluid which is to be dispensed.

A layer suitable for giving good properties of mechanical strength may for example consist of polyethylene terephthalate (PET).

A layer suitable for giving good gas-barrier properties may for example be made of nylon, especially nylon-MXD6, or ethylene/vinyl alcohol (or EVOH) or silicon dioxide.

A layer suitable for giving good properties of chemical resistance may also consist of for example polyethylene terephthalate or polyethylene naphthalate (PEN).

The variable-volume bag may thus be made as a PET/nylon/PET or PET/nylon/PEN laminate, i.e. it may have an outer layer of polyethylene terephthalate, an intermediate layer of nylon, and an inner layer, that is a layer designed to be in contact with the fluid to be dispensed also, of polyethylene terephthalate or polyethylene naphthalate; it can also be made as a PET/EVOH/PET or PET/EVOH/PEN laminate.

A PET/nylon/PET or PET/nylon/PEN type material can have the further advantage of being transparent. Hence, if it is wished to improve the transparency properties, the percentage of products conferring a barrier effect should be reduced. For example, small percentages of nylon (3 to 8% of the total weight of the polymer) give a completely transparent material.

Such laminates can be produced by coextrusion or coinjection molding techniques with the aid of technologies such as those developed by KORTEC Inc. Ipswich, Mass. 01938, USA.

It is also conceivable to deposit a layer, silicon dioxide for example, by vapor deposition. The layer so deposited can be extremely thin, measuring a few microns thickness only. The technology to be used may be for example that developed by SIG Corpoplast Inc. under the name PLASMAX.

Such a layer can be deposited on a conventional single-layer material or on a laminate prepared by coextrusion or coinjection molding.

In one particular embodiment, said open end is provided with an inner or outer reinforcing collar which gives it its properties of dimensional stability and which is made of a material less sensitive to heat variations, such as nylon-6,6 or acetal copolymer or polymer or even a corrosion-resistant metal such as, for example, AISI 316 in the case of an inner collar. More precisely, part of the material of the open end is replaced by said outer or inner collar, the general shape and dimensions of the open end therefore being no different to those of an embodiment that has no reinforcement at all. To create an intimate bond between the reinforcing collar and the material of the open end, the procedure below should be followed.

In the case of an outer collar, this is positioned around the open end of the bag and the inner surface of said collar corresponds intimately to the outer wall of said open end. To this purpose the reinforcing collar is positioned in the mold in which the bag is to be made and the polymer is injected into said mold.

In the case of an inner collar, the external shape of said collar must be complementary to the inside shape of said open end. This collar can be produced (in advance) by an injection molding process, and must be positioned in the injection/stretch-blow mold by a mechanical pick-and-place mechanism.

In another embodiment, at least part of the open end of said bag is made of a material different from the rest of the bag, this material being less sensitive to heat variations—nylon-6,6 or acetal copolymer or polymer, for example—and being compatible with it so that the materials form an intimate blend when extruded. To promote this intimate blending, the two constituent materials are forced in opposite directions to each other.

In another embodiment, the open end of said bag is made larger than its final size and heat set under controlled conditions of time and temperature. In such a process, the open end is made larger than its final size before being heat treated under controlled conditions of time and temperature and if necessary placed in a reforming mold. This reforming mold contains jaws having passages which allow circulation of a coolant, which may be chilled water for example. The final temperature of the open end of the variable-volume bag can thus be controlled. The use of a reforming mold and cooling are intended not simply to cool the material to ambient temperature but also to ensure that the heated component will have the precise shapes and dimensions necessary for its future use.

Clearly, the conditions of the heat treatment, that is the temperature and duration, will depend on the shape, dimensions and material of said open end. How much larger it is made than its final size will depend also on the heat treatment conditions and the required end properties.

The heat treatment may be applied to just the outermost part of the surface of said end rather than through its entire thickness.

The component is made approximately 2 to 6%, preferably 3 to 5% larger than its final size. The duration of the heat treatment is approximately 10 s to approximately 60 s, preferably approximately 20 s to approximately 50 and still more preferably approximately 30 s to approximately 45 s, and the temperature is between approximately 120° C. and 350° C., preferably between approximately 140° C. and approximately 330° C. and still more preferably between approximately 150° C. and approximately 290° C.

In one particular embodiment, the bag according to the invention is fitted with a mean for dispensing the fluid it is intended to contain, said mean comprising a control for opening a valve to dispense said fluid, said system preferably being a spray device.

The fluid dispensing system is advantageously connected to the bag by a cap or cup which also enables the assembly to be attached to the outer container in which the bag is to be placed.

The invention also relates to a device suitable for dispensing fluids under pressure, comprising a container able to withstand a high internal pressure, through the opening or neck of which there is introduced a variable-volume bag according to the invention and as described above, said bag containing the fluid to be dispensed and being fitted with a fluid dispensing device comprising a control C for opening a valve V to dispense said fluid, the internal volume of the container between its wall and the variable-volume bag being filled with an inert gas at sufficient pressure to exert on said variable-volume bag a pneumatic stress sufficient to enable the fluid which it contains to be dispensed when said valve is actuated by said control C.

The bag is of variable volume so that when emptied it can be evacuated of air to enable it to be introduced through the opening or neck of the outer container and so that it is able to expand when filled with the fluid. It is especially advantageous for the inner bag to have longitudinal folds as described in the Applicant's patent applications referred to above. In making said bag, the processes described in the four United States patents identified above and more particularly in U.S. Pat. No. 4,387,833, from column 3, line 63 to column 4, line 16 may be employed.

In one advantageous embodiment, said outer container has only one opening, which is that through which the variable-volume bag is inserted. This opening must also allow said container to be filled with an inert gas under pressure as described in the Applicant's patent applications referred to above.

The outer container of the device of the invention is intended to contain a gas under pressure and must therefore be capable of withstanding a pressure of greater than 5 bar, preferably greater than 8 bar, more preferably greater than 12 bar and may even be capable of withstanding pressures greater than 20 bar.

The outer container may be made of the same material as the bag. However, given the fact that this material is not in contact with the fluid which is to be dispensed, it is quite possible to use a two-layer laminate, such as polyethylene terephthalate and nylon.

Such a material without an inner layer providing chemical resistance could also be used for said bag provided the fluid to be dispensed is chemically compatible with the other layers.

In one particular embodiment, the variable-volume container containing the fluid to be dispensed and the pressure-resistant outer container are made of transparent materials, so that the user can see the fluid and can see how full or empty the device is at any time. Similarly, any deterioration in the fluid which would lead to a change in its appearance (such as color, phase separation, etc.) can be detected by the user.

The invention also relates to the process for filling a device according to the invention in which there is introduced through the opening of the outer container the bag fitted with the fluid dispensing device, the pressurized gas is introduced through a space between the wall of the container and the bag, the two components are sealed together by for example crimping, screwing or welding, and the inner bag is then filled with the fluid by forcing the valve.

The invention also relates to other arrangements which are preferably used at the same time and which will be discussed explicitly below.

Figure 1B:
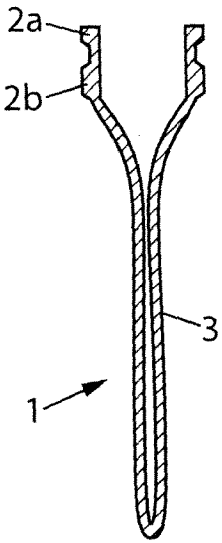
Figure 1A:
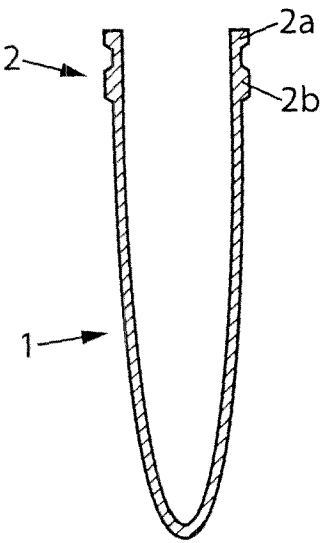
Figure 2A:
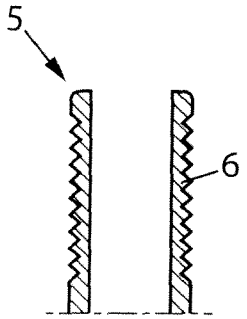
Figure 2B:
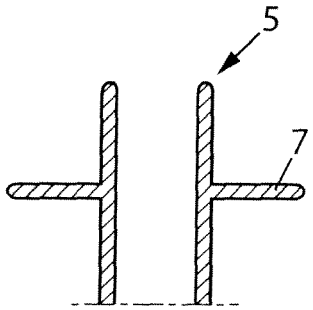
Figure 3:
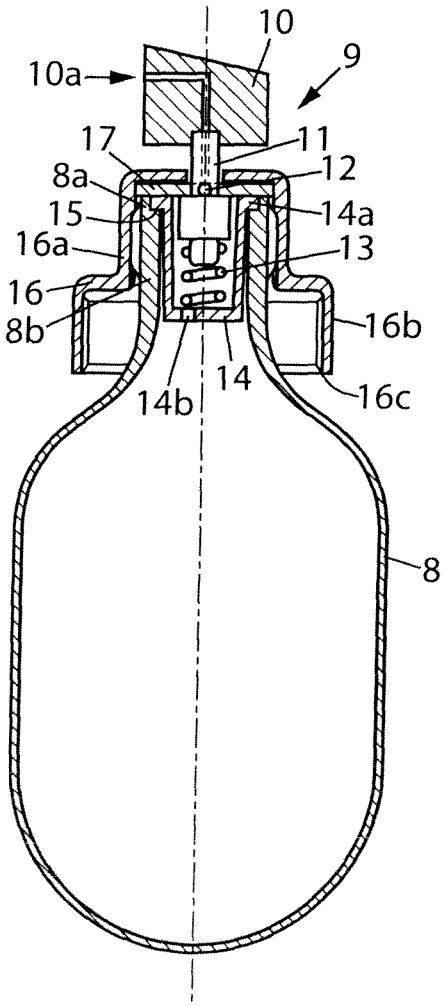
Figure 4:
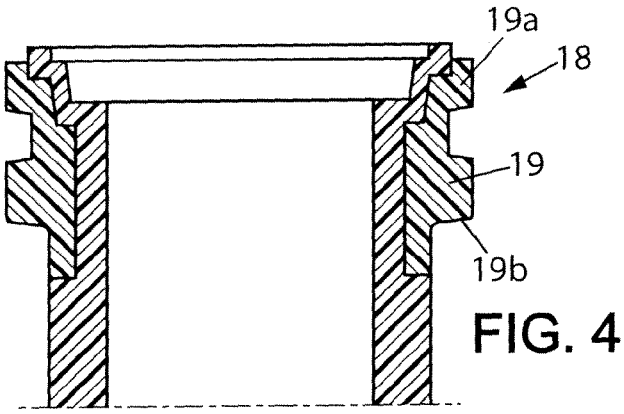
Figure 5:
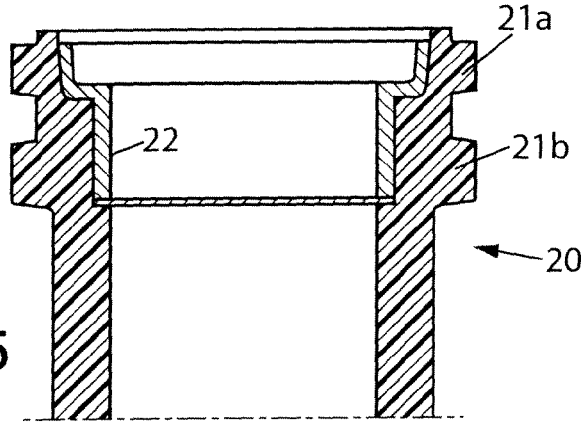
Figure 6:
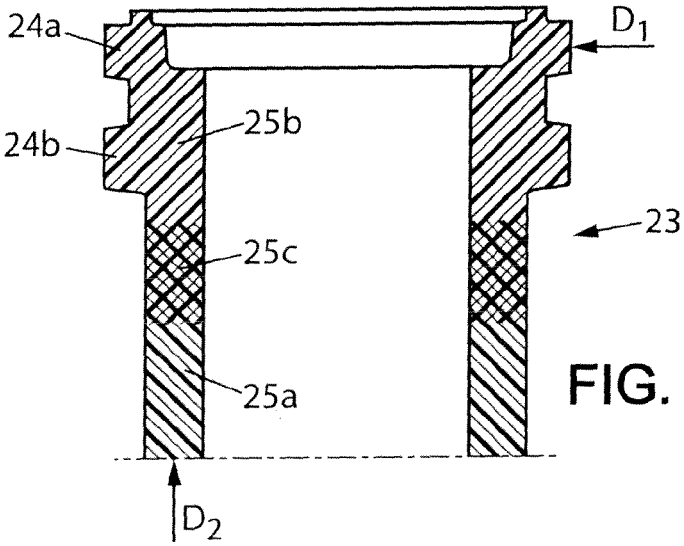
Figure 7:
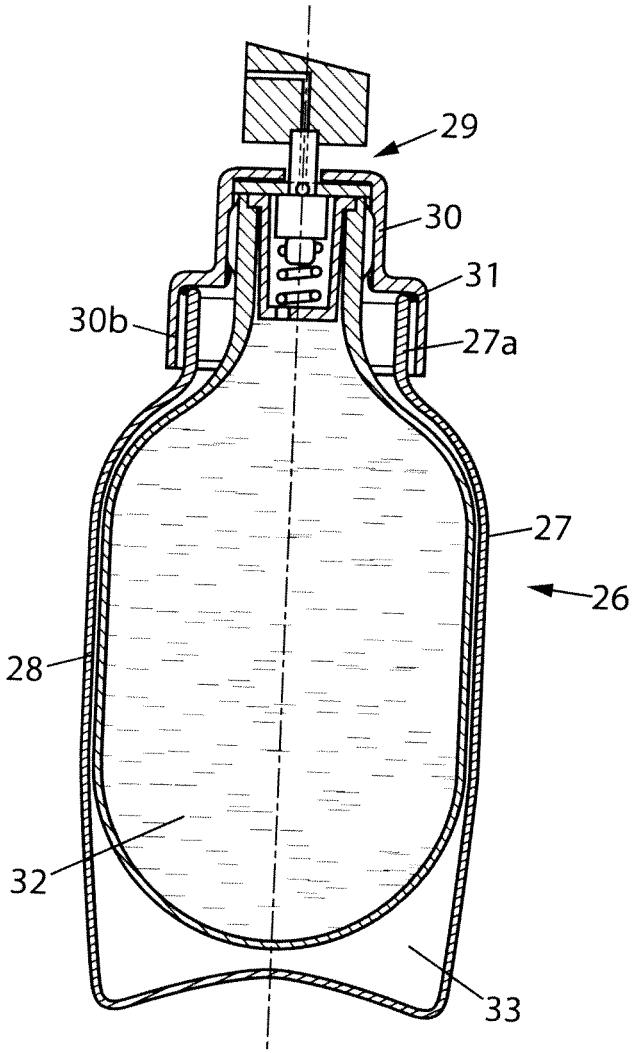

A clearer understanding of the invention will be gained from the further description of certain non-restrictive embodiments illustrated in the drawings, in which:

FIGS. 1*a* to 1*c* are a longitudinal section through an embodiment of the bag according to the invention showing it at different volumes, FIGS. 2*a* and 2*b* both show an enlarged cross section through an embodiment of the open end of said bag, one with a screw fastening shape and the other with an outer fixing ring for welding, FIG. 3 is a longitudinal section through said bag fitted with a spray device, FIG. 4 is a section through the open end of the bag of the invention comprising an outer collar, FIG. 5 is a section through the open end of the bag of the invention comprising an inner reinforcing collar, FIG. 6 is a section through the open end of the bag of the invention made of a different material than the bag, and FIG. 7 is a section through a filled device in accordance with the invention.

As shown in FIGS. 1*a* and 1*b*, the container 1 of the invention is of variable volume and takes the form of a bag with an open end 2, on the outer part of which are protuberances 2*a* and 2*b*. In FIG. 1*a* the bag is shown in its free condition, meaning that it is not under any stress. In FIG. 1*b* the bag is shown after its air has been evacuated either by suction or by mechanical pressure on its wall 3. FIG. 1*c* shows a bag filled with liquid 4, the volume of the bag now being greater than when it was under no stress.

FIGS. 2*a* and 2*b* show two different embodiments of the open end 5 of the bag according to the invention. In FIG. 2*a*, the open end 5 is provided on its outer part with a screwthread 6. In FIG. 2*b* said open end is provided with a radial ring 7.

FIG. 3 shows a variable-volume container 8 fitted with a spray system 9 comprising a pushbutton 10 operating a hollow control rod 11 pierced by a hole 12 giving communication between the interior of the bag and the cavity of the control rod. Running through said pushbutton is a channel 10*a* aligned with the cavity of the hollow control rod 11, and said control rod 11 presses on a spring 13 held in a spring cup 14, the free edge 14*a* of said cup resting on a shoulder 15 formed on the inner face of the free edge 8*a* of the bag. Together, the cup, the spring and the control rod are held in place by a cap 16 screwed onto the open end 8*b* of said bag. In the cup 14 is a hole 14*b* so that the fluid to be dispensed can move from the variable-volume bag toward the hole 12 in the control rod 11. The outer wall of the open end 8*b* has a complementary screwthread to the screwthread formed on the inner lateral wall 16*a* of the cap 16. A flat seal 17 prevents leaks between the control rod 11 and the free edge 8*a* of the bag 8 and also between the bag 8 and the cap 16. The cap 16 has an extension 16*b* whose diameter is greater than the diameter of the part 16*a* engaged on the open end 8*b* of the bag and its inner face has a screwthread 16*c*. This screwthread is designed to engage with the screwthread of an outer container in which said bag 8 is to be inserted.

FIG. 4 shows the open end 18 of the bag according to the invention, fitted on its outer wall with a reinforcing collar 19, on the outer periphery of which are two protuberances 19*a* and 19*b*.

FIG. 5 shows the open end 20 of the bag according to the invention with two protuberances 21*a* and 21*b* in its outer wall and an inner wall complementary to the outer shape of a reinforcing collar 22.

FIG. 6 shows the open end 23 of another embodiment of the bag according to the invention with an outer wall having two protuberances 24*a* and 24*b*, said wall being formed from two different materials, the material of the bag in the lower part 25*a*, a material less sensitive to thermal variations in the upper part 25*b* (that nearest the free end) and a mixed material in the intermediate region 25*c*. In this figure, the arrows D1 and D2 show the directions of injection of these materials. Thus, the material of the bag is injected from the bottom of the bag toward its open end and the material that is less sensitive to heat variations is injected into the protuberance 24*a* at right angles, at D2, and pushed in the opposite direction to that of the material of the bag. The two materials thus blend together in area 25*c*.

FIG. 7 shows a device according to the invention bearing the general reference 26. This device comprises an outer container 27 of generally cylindrical shape with one opening at its top part 27*a*. The outer wall of the part 27*a* is threaded. A bag 28 with a spray device 29 as shown in FIG. 3 has been introduced through the opening of said container 27. The outer container is screwed onto the cap of the spray device 29, the inner wall of the extension 30*b* of which is correspondingly threaded. An O ring 31 seal is placed between the free edge of the outer container 27 and the cap 30. Said bag 28 is filled with liquid 32 and the space 33 between the inner wall of the outer container 27 and said bag 28 is filled with gas under pressure.

As a result, irrespective of the particular embodiment adopted, the user has a device of the type in question whose features are sufficiently clear from the above account for it to be unnecessary to recite them again, but essentially the device has numerous advantages over existing devices, including in particular being highly reliable, very robust, having a competitive cost price, and being completely leakproof even under extreme conditions of use and storage.

The invention claimed is:

1. A method for manufacturing a bag of variable volume able to contain fluids and designed to be introduced into an outer container through the container's neck, said bag consisting of a pouch with one closed end and one open end, the open end being dimensionally stable over temperature ranges of from −30 to 55° C., the method comprising a step consisting of making the open end approximately 2 to 6% larger than its final size; and applying a heat treatment at least to the outermost part of the surface of said open end for a period of approximately 10 s to approximately 60 s at a temperature between approximately 120° C. and 350° C., thereby the coefficient of expansion of said open end is divided by 1.5 by comparison with the rest of the bag in a range of temperatures of from −30 to 55° C.

2. The method as claimed in claim 1, wherein the outer wall of the open end has a screwthread.

3. The method as claimed in claim 1, wherein the outer wall of the open end has at least one radial protuberance designed for crimping.

4. The method as claimed in claim 1, wherein the outer wall of the open end has at least one lateral ring designed for welding.

5. The method as claimed in claim 1, wherein the open end consists in part of an inner or outer reinforcing collar.

6. The method as claimed in claim 5, wherein the reinforcing collar is made of a material less sensitive to thermal variations than the material of the bag.

7. The method as claimed in claim 2, wherein at least part of the open end is made of a material less sensitive to the thermal variations than the material of the bag.

8. The method as claimed in claim 1, wherein it is made larger than its final size and heat treated before being placed in a mold and cooled.

9. The method as claimed in claim 1, wherein it is fitted with a control for opening a valve to dispense the fluid it is intended to contain.

10. The method as claimed in claim 3, wherein at least part of the open end is made of a material less sensitive to the thermal variations than the material of the bag.

11. The method as claimed in claim 1, wherein the bag is made of a transparent material and is intended to be introduced into an outer container which is made of transparent materials.

12. The method as claimed in claim 1, wherein, in a range of temperatures of from −30 to 55° C., the coefficient of expansion of said end is divided by 2 by comparison with the rest of the bag.

13. The method as claimed in claim 1, wherein, in a range of temperatures of from −30 to 55° C., the coefficient of expansion of said end is divided by 3 by comparison with the rest of the bag.

14. The method of claim 9 where said control for opening a valve is a spray device.

* * * * *